US012529537B2

(12) United States Patent
Kent

(10) Patent No.: US 12,529,537 B2
(45) Date of Patent: Jan. 20, 2026

(54) UNJAMMING MULTITOOL FOR FIREARMS

(71) Applicant: Howard Kent, Waldport, OR (US)

(72) Inventor: Howard Kent, Waldport, OR (US)

( * ) Notice: Subject to any disclaimer, the term of this patent is extended or adjusted under 35 U.S.C. 154(b) by 483 days.

(21) Appl. No.: 18/154,487

(22) Filed: Jan. 13, 2023

(65) Prior Publication Data

US 2024/0240893 A1 Jul. 18, 2024

(51) Int. Cl.
*F41A 15/22* (2006.01)
*F41A 29/02* (2006.01)

(52) U.S. Cl.
CPC ..... *F41A 15/22* (2013.01); *F41A 29/02* (2013.01)

(58) Field of Classification Search
USPC ..... 81/3.05
See application file for complete search history.

(56) References Cited

U.S. PATENT DOCUMENTS 673,609 A * 5/1901 Sullivan et al. ..... B26B 11/00 7/118
929,526 A * 7/1909 Whitman ..... F41A 15/22 294/94
1,067,383 A * 7/1913 Southgate ..... F41A 29/02 285/302
1,097,350 A * 5/1914 Neukirchen ..... G01B 3/06 33/458
1,275,803 A * 8/1918 Wallace ..... F41A 15/22 294/94
1,326,569 A * 12/1919 Burdett ..... F41A 15/22 294/94
2,363,520 A * 11/1944 Fish ..... F41A 29/02 403/379.5
2,379,962 A * 7/1945 Hoerle ..... F41A 29/02 15/104.165
2,489,285 A * 11/1949 Gorichan ..... F41A 15/22 29/280
2,520,974 A * 9/1950 Spinnato ..... F41A 15/22 29/282
2,744,275 A * 5/1956 Geltner ..... F41A 29/00 206/229
3,316,780 A * 5/1967 Herkner ..... F42B 33/06 294/195

(Continued)

*Primary Examiner* — Monica S Carter
*Assistant Examiner* — Jonathan R Zaworski
(74) *Attorney, Agent, or Firm* — Parsons & Goltry; Robert A. Parsons; Michael W. Goltry

(57) ABSTRACT

An unjamming multitool for use with a firearm, including a housing having opposing parallel side plates joined at an edge and having a first end and an opposing second end, and defining a cavity therebetween. A first pivot post and a second pivot post are carried at the first and second ends of the housing. An extractor assembly is pivotally coupled to the first end of the housing by the first pivot post and movable between a stored position adjacent the housing and a deployed position wherein the extractor assembly is pivoted outwardly from the housing about the first pivot post to a stop. A bolt over-ride claw coupled to the opposing second end of the housing by the second pivot post, and movable between a stored position generally within the cavity of the housing and a deployed position pivoted outwardly from the cavity to a 90 degree stop. A collapsible range rod movable between a stored position against one of the opposing parallel side plates and a deployed position extending from the one of the opposing parallel side plates.

16 Claims, 9 Drawing Sheets

(56) References Cited

U.S. PATENT DOCUMENTS 4,407,086 A * 10/1983 Hasselmann ..... F41A 15/22 42/90
5,127,179 A * 7/1992 Marsh ..... F41C 9/085 42/95
5,225,614 A * 7/1993 Harchar ..... F41C 9/085 81/3.05
5,345,706 A * 9/1994 Brown ..... F41A 23/06 42/94
5,416,940 A * 5/1995 Bandera ..... B25F 1/04 7/118
5,431,073 A * 7/1995 Gregory ..... B25B 27/06 81/3.05
5,775,021 A * 7/1998 Weiss ..... F41A 29/02 42/95
5,934,001 A * 8/1999 Pace ..... F41A 29/02 42/95
7,174,667 B2 * 2/2007 Connal ..... F41A 35/00 42/108
7,637,049 B1 * 12/2009 Samson ..... F41C 23/22 42/108
7,644,529 B2 * 1/2010 Hopper ..... F41A 29/02 42/108
8,091,266 B2 * 1/2012 Huang ..... F41G 1/545 42/108
8,166,850 B2 * 5/2012 Caniparoli ..... B25G 1/085 7/137
8,607,494 B2 * 12/2013 Shipman ..... F41A 29/02 42/95
9,127,899 B2 * 9/2015 Shipman ..... F41G 1/545
9,138,881 B2 * 9/2015 Caniparoli ..... B25F 1/003
10,274,271 B2 * 4/2019 Cozzo ..... F41A 11/00
10,442,068 B2 * 10/2019 Caniparoli ..... B25F 1/003
11,458,609 B2 * 10/2022 Caniparoli ..... B25F 1/003
2006/0168870 A1 * 8/2006 Haponski ..... F41A 35/00 42/108
2009/0199345 A1 * 8/2009 Morgan ..... F41A 29/02 42/108
2015/0360362 A1 * 12/2015 Chapman ..... B25F 1/006 7/167

* cited by examiner

UNJAMMING MULTITOOL FOR FIREARMS

FILED OF THE INVENTION

This invention relates to firearms and more specifically to tools for removing jammed cartridges.

BACKGROUND OF THE INVENTION

Cartridges in most firearms today include a casing containing a propellant charge, a primer and a projectile. The case is typically made of brass or another metal alloy that resists corrosion and pressure. These cartridges are cycled into a firearm's firing chamber for firing a projectile at a target. A firearm's action typically directs a cartridge into the firing chamber and ejects the casing of the fired cartridge from the firing chamber. Many types of actions are in use today, but for present purposes, manually operated, semi-automatic action and fully-automatic action are considered. In each of these instances, the action of the firearm includes an extractor which removes the casing from the firing chamber. The casing includes a rim which is engaged by the extractor for removal/

Through various causes, a cartridge can be damaged, bent, deformed, dirty, corroded or weakened through multiple reloads or the like. The firearm can also be dirty, corroded, damaged or otherwise impaired. These conditions can result in improper insertion of the cartridge or improper extraction of the casing. In other words, the cartridge may become difficult to load or unload or may even jam somewhere in the action or in the firing chamber. This jamming is common when old, low-quality and/or dirty ammunition is used or when a weapon is dirty, unlubricated and/or damaged. The AR-15 is a very common semi-automatic rifle in use today. This rifle uses a direct impingement gas action with a rotary bolt locking mechanism. The direct impingement gas operation design directs hot exhaust gases from the rifle barrel, through a tube, against a bolt key and then into the bolt carrier. This design allows hot combustion gases to flow over the bolt carrier and action of the weapon. After extended use, these combustion gases will cause a buildup of residue that can cause the action to jam.

The present invention is concerned primarily with the top three causes of cartridge and case failure related jams in firearms either in feeding live rounds or ejecting spent ones. The three primary causes include a stuck case resulting from a broken rim, a case head separation and a bolt over-ride feed. The broken rim leaves the spent casing in the firing chamber. Since the rim is broken, the extractor cannot engage the casing for removal. This requires a rod or the like to be inserted down the barrel into the casing and tapped against the case head to force the casing out of the firing chamber. When a case head separation occurs, a rod down the barrel will not be functional since there is no longer a case head to engage to force the casing out of the firing chamber. Other tools are required. In the case of bolt over-ride feed, the jam occurs when a cartridge or casing is wedged between the top of the bolt and the area above it. The bolt is stuck partially open and prevented from moving.

While a jammed firearm may be relatively easily unjammed by a gunsmith in a workshop, in the field during combat, hunting or simple target practice, a jammed firearm can be a matter of life and death, a failed hunt, or aggravation, respectively. A tool which can handle each of these types of stoppages needs to be available and easily used.

It would be highly advantageous, therefore, to remedy the foregoing and other deficiencies inherent in the prior art.

An object of the present invention is to provide a tool which can remedy each of these stoppages when they occur.

SUMMARY OF THE INVENTION

Briefly to achieve the desired objects and advantages of the instant invention in accordance with a preferred embodiment provided is an unjamming multitool for use with a firearm. Th unjamming multitool includes a housing having a first end and an opposing second end, an extension arm having a distal end, and a pivot end pivotally coupled to the first end of the housing by a pivot post and movable between a stored position adjacent the housing and a deployed position wherein the extension arm is pivoted outwardly from the housing about the pivot post to a stop, a shaft coupled to the distal end of the extension arm by a rotating ferrule for movement between a stored position parallel to the extension arm and a deployed position perpendicular to the extension arm, and an extractor element coupled to an end of the shaft by a spacer.

In a further aspect, an unjamming multitool for use with a firearm is provided and includes a housing having opposing parallel side plates joined at an edge and having a first end and an opposing second end, the opposing parallel side plates defining a cavity therebetween, a first pivot post carried at the first end and extending between the opposing parallel side plates through the cavity and a second pivot post carried at the second end of the housing and extending between the opposing parallel side plates through the cavity. An extractor assembly is pivotally coupled to the first end of the housing by the first pivot post and movable between a stored position adjacent the housing and a deployed position wherein the extractor assembly is pivoted outwardly from the housing about the first pivot post to a stop. A bolt over-ride claw is coupled to the opposing second end of the housing by the second pivot post, and movable between a stored position generally within the cavity of the housing and a deployed position pivoted outwardly from the cavity to a 90 degree stop. A collapsible range rod is movable between a stored position against one of the opposing parallel side plates and a deployed position extending from the one of the opposing parallel side plates.

The range rod includes a base segment having an end pivotally coupled to one of the opposing parallel side plates opposite the cavity and movable between a stored position against the one of the opposing parallel side plates and a deployed position. The base segment is movable 180 degrees and extends from the one of the opposing parallel side plates and includes a slotted end. An intermediate segment having opposed slotted ends is provided. A terminal segment having a terminal end and an opposing slotted end is also provided. A first linkage couples the slotted end of the base segment to one of the slotted ends of the intermediate segment. A second linkage couples the other of one of the slotted ends of the intermediate segment to the slotted end of the terminal segment. The base segment, the intermediate segment and the terminal segment are movable between a stored position wherein each is position parallel to each other and resting against the one of the opposing side plates, and a deployed configuration wherein the base segment, the intermediate segment and the terminal segment extend linearly and are swiveled away from the one of the opposing side plates by up to 180 degrees.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION

Figure 3:
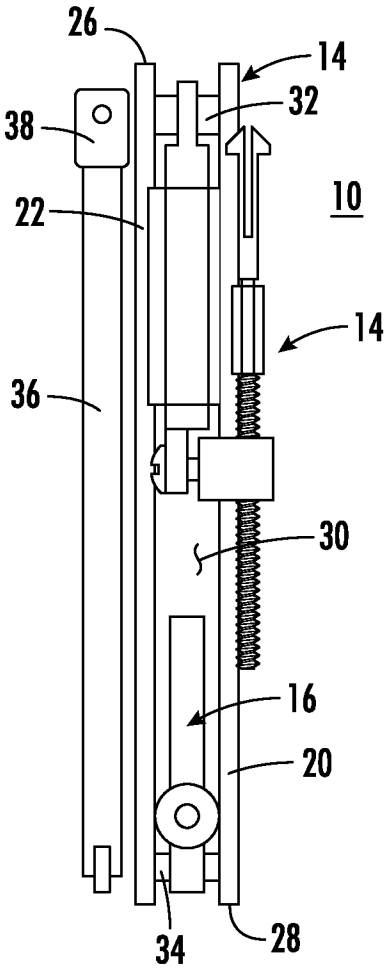
FIG. 3 is a side view of the unjamming multitool of FIG. 1.
Figure 2:
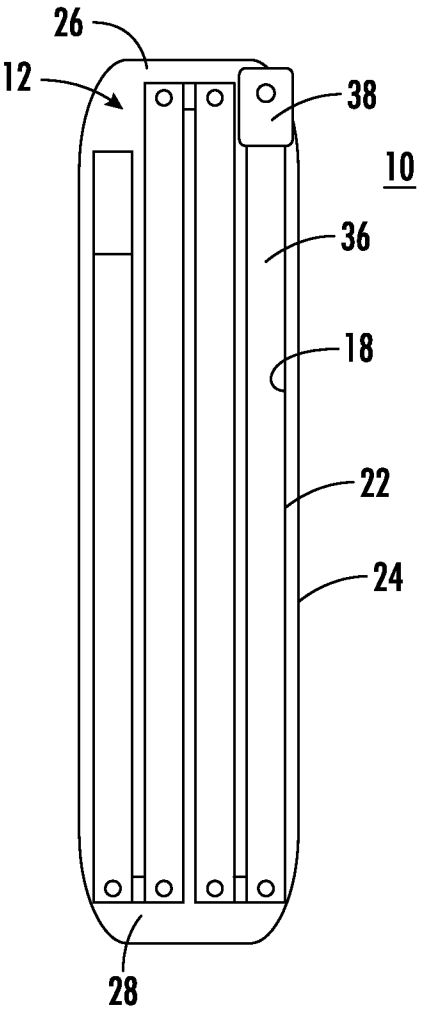
FIG. 2 is a back view of the unjamming multitool of FIG. 1.
Figure 1:
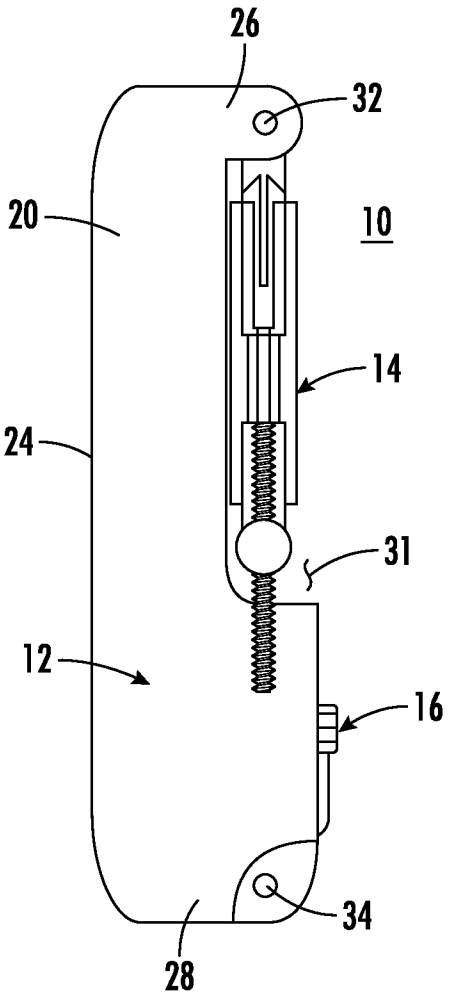
FIG. 1 is a front view of an unjamming multitool according to the present invention.
Figure 4:
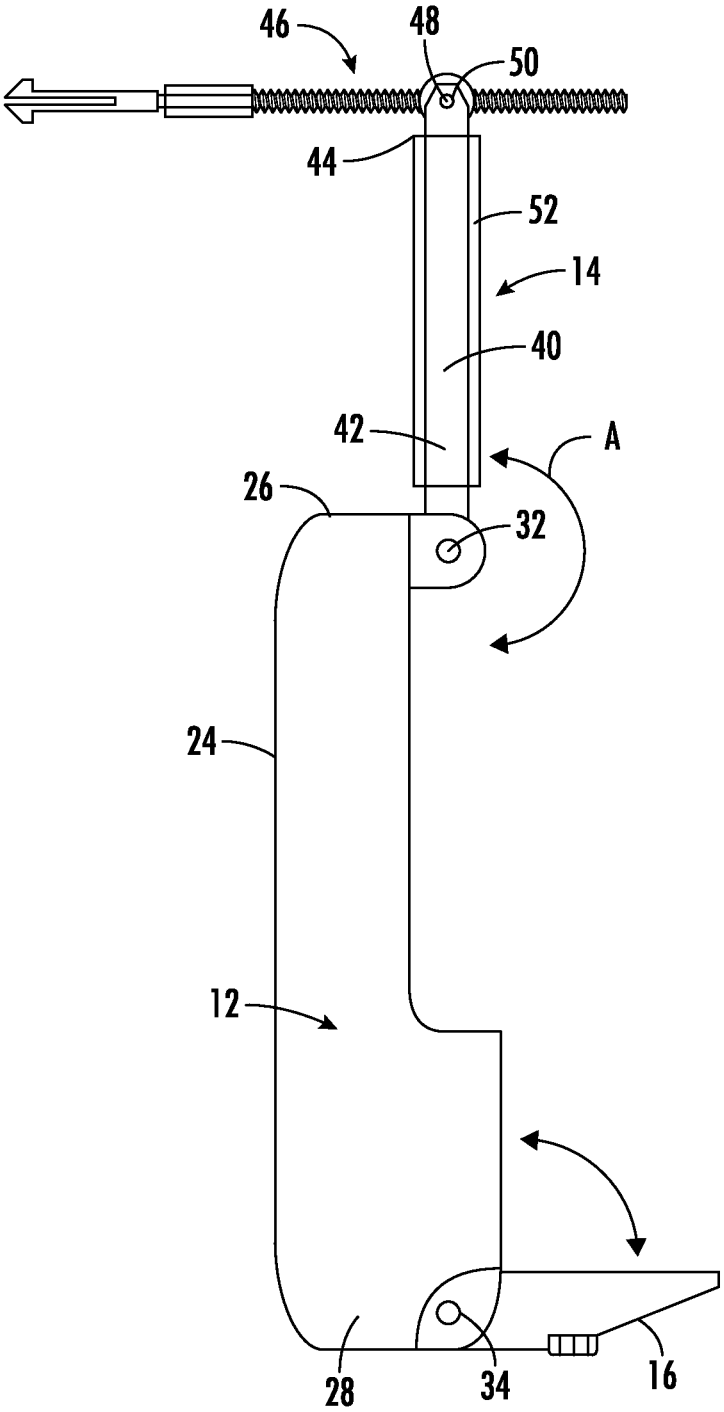
FIG. 4 is a front view of the unjamming multitool of FIG. 1 with portion thereof deployed for use.

Turning now to the drawings in which like reference characters indicate corresponding elements throughout the several views, attention is directed to FIGS. 1, 2 and 3 which illustrate an unjamming multitool according to the present invention, generally designated 10. Unjamming multitool 10 is applicable to any cartridge firearm with an ejection port adjacent to the chamber including virtually all modern designs. Unjamming multitool 10 includes a housing 12 also acting as a handle, an extractor assembly 14, a bolt over-ride claw 16 and a collapsible range rod 18. Housing 12 includes opposing parallel side plates 20 and 22 joined at edge 24 and having opposing ends 26 and 28. Side plates 20 and 22 defining a cavity 30 therebetween. Pivot posts 32 and 34 are carried at opposing ends 26 and 28, respectively, and extend between side plates 20 and 22. A notch 31 is formed in side plates 20 and 22. Extractor assembly 14 is pivotally coupled to end 26 of housing 12 by pivot post 32 and movable between a stored position adjacent housing 12, generally within notch 31 and cavity 30 of housing 12 and a deployed position pivoted outwardly from cavity 30 about pivot post 32 (FIG. 4). Bolt over-ride claw 16 is pivotally coupled to end 28 of housing 12 by pivot post 34 and movable between a stored position generally within cavity 30 of housing 12 and a deployed position pivoted outwardly from cavity 30 about pivot post 34 (FIG. 4) generally perpendicular to housing 12.

Figure 5:
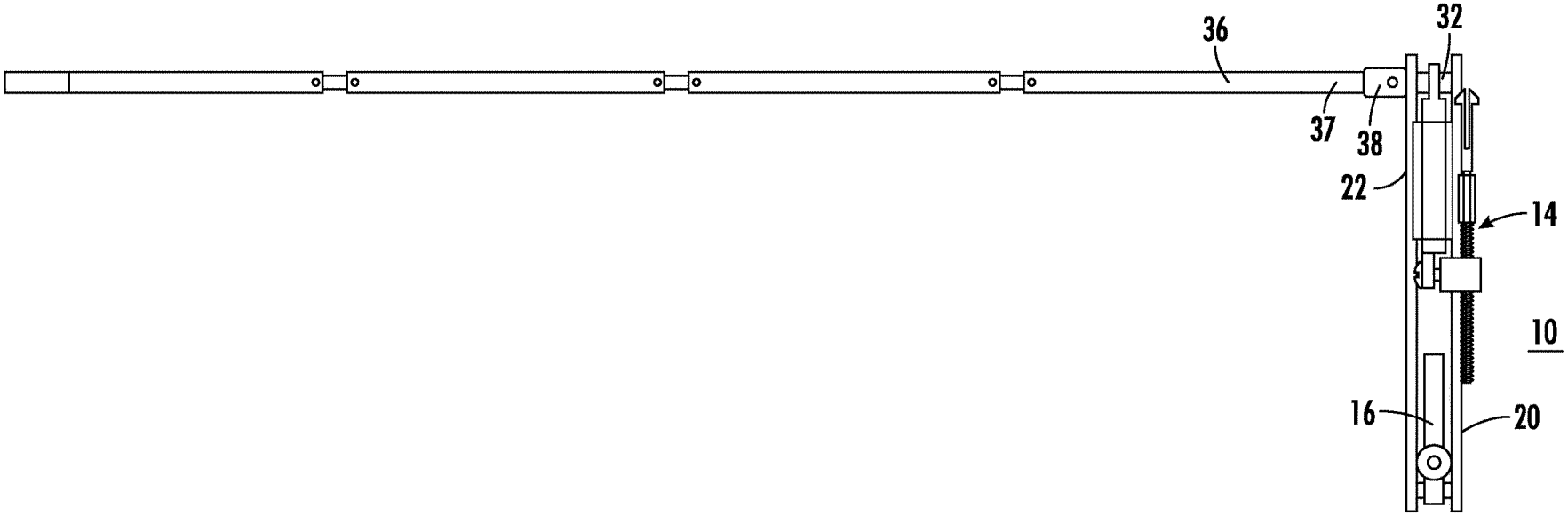
FIG. 5 is a side view of the unjamming multitool of FIG. 3 with a portion thereof deployed for use.
Figure 6:
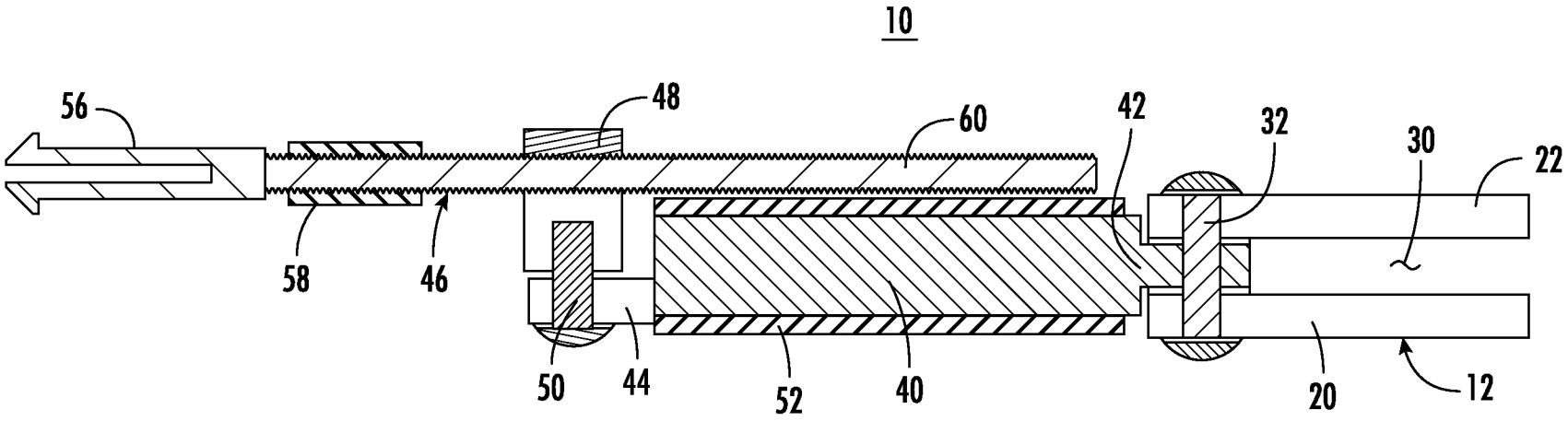
FIG. 6 is a partial sectional side view of the unjamming multitool, illustrating the extraction assembly in the deployed position.

Referring specifically to FIGS. 2, 3 and 5, collapsible range rod 18 includes a base segment 36 having an end 37 pivotally coupled to a bracket 38 couple adjacent to side plate 22 opposite cavity 30. As will be described presently, collapsible range rod 18 includes a plurality of segments movable between a stored configuration wherein each of the plurality of segments is position parallel to each other and resting against side plate 22, and a deployed configuration wherein each of the plurality of segments extend linearly end to end from end 37 of base segment 36, and can be swiveled away from side plate 22 up to 180 degrees. (FIG. 5). Referring now to FIG. 6, with continued reference to FIG. 4, extractor assembly 14 includes an extension arm 40 having a pivot end 42 pivotally coupled to pivot post 32 and a distal end 44. Extension arm 40 is movable from the stored position generally within notch 31 and cavity 30 of housing 12 to the deployed position pivoted outwardly 180 degrees along arrowed line A to a hard stop or lock. An extractor tip 46 is coupled to distal end 44 of extension arm 40 by a rotating ferrule 48. Rotating ferrule 48 allows extractor tip 46 to rotate from a stored position parallel to extension arm 40 to a deployed position perpendicular to extension arm 40. Rotating ferrule 48 is pivotally coupled to a pivot post 50 extending from distal end 44. Extension arm 40 is preferably covered by a guard sleeve 52 for purposes which will be described presently.

Figure 7:
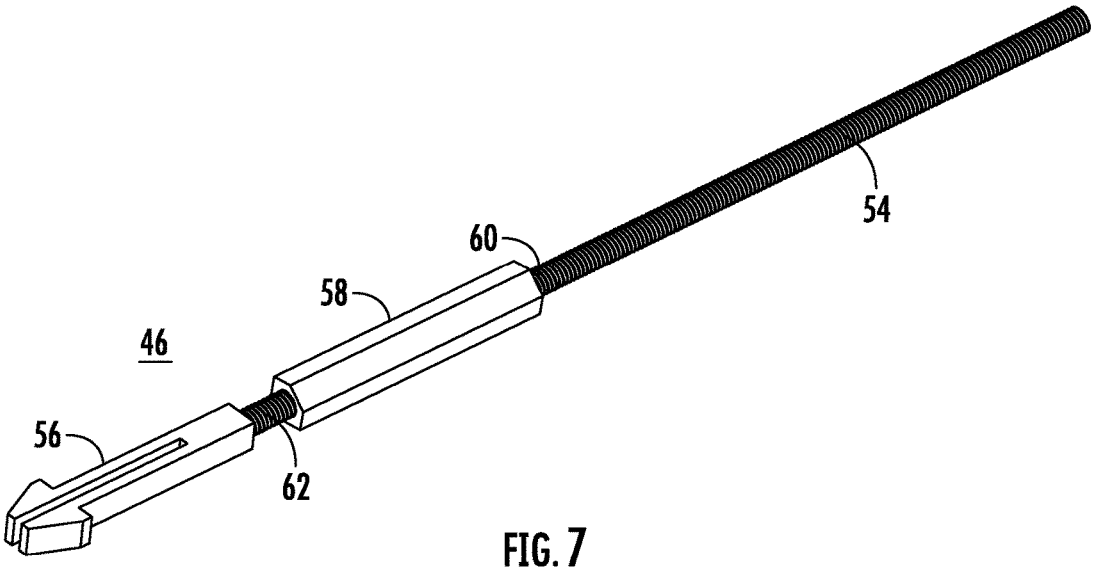
FIG. 7 is a perspective view of the extractor tip according to the present invention.
Figure 8:
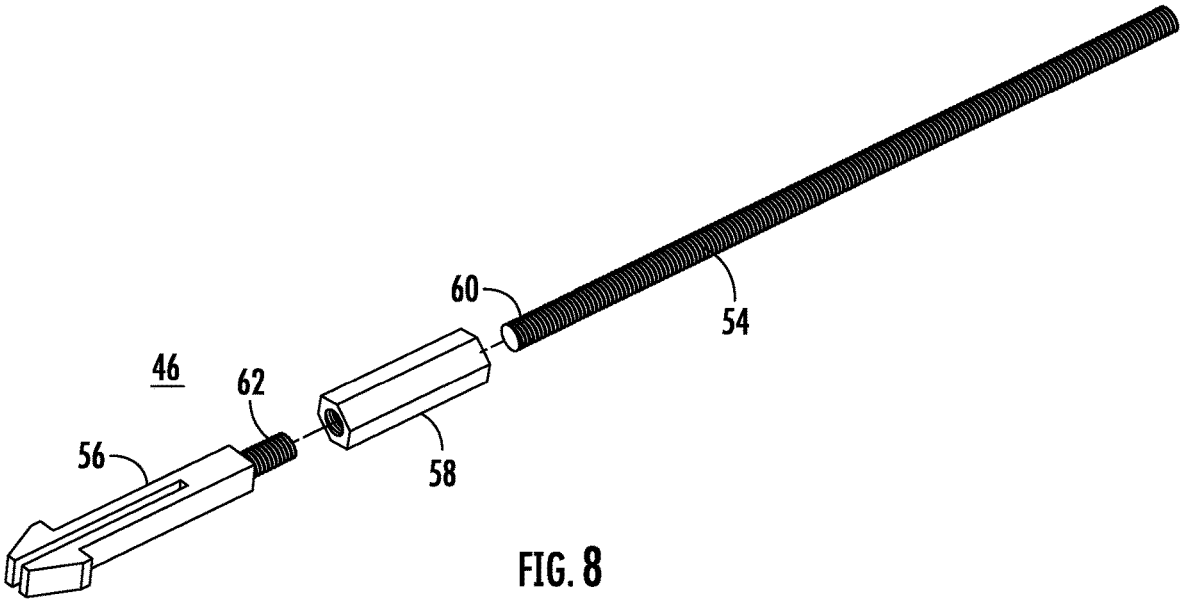
FIG. 8 is an exploded view of the extractor tip of FIG. 7.

With additional reference to FIGS. 7 and 8, extractor tip 46 includes a threaded shaft 54 coupled to an extractor element 56 by a spacer 58. An end 60 of shaft 54 is threaded into spacer 58, and a threaded end 62 of extractor element 56 is threaded into the opposite end of spacer 58. Extractor element 56 is of conventional design for receipt by a case with a separated head. Extractor tip 46 is adjustably coupled to extension arm 40 by threaded shaft 54 being threaded through rotating ferrule 48. The length of extractor tip 46 can be adjusted by threading threaded shaft 54 through rotating ferrule 48 more or less, as desired.

Figure 9:
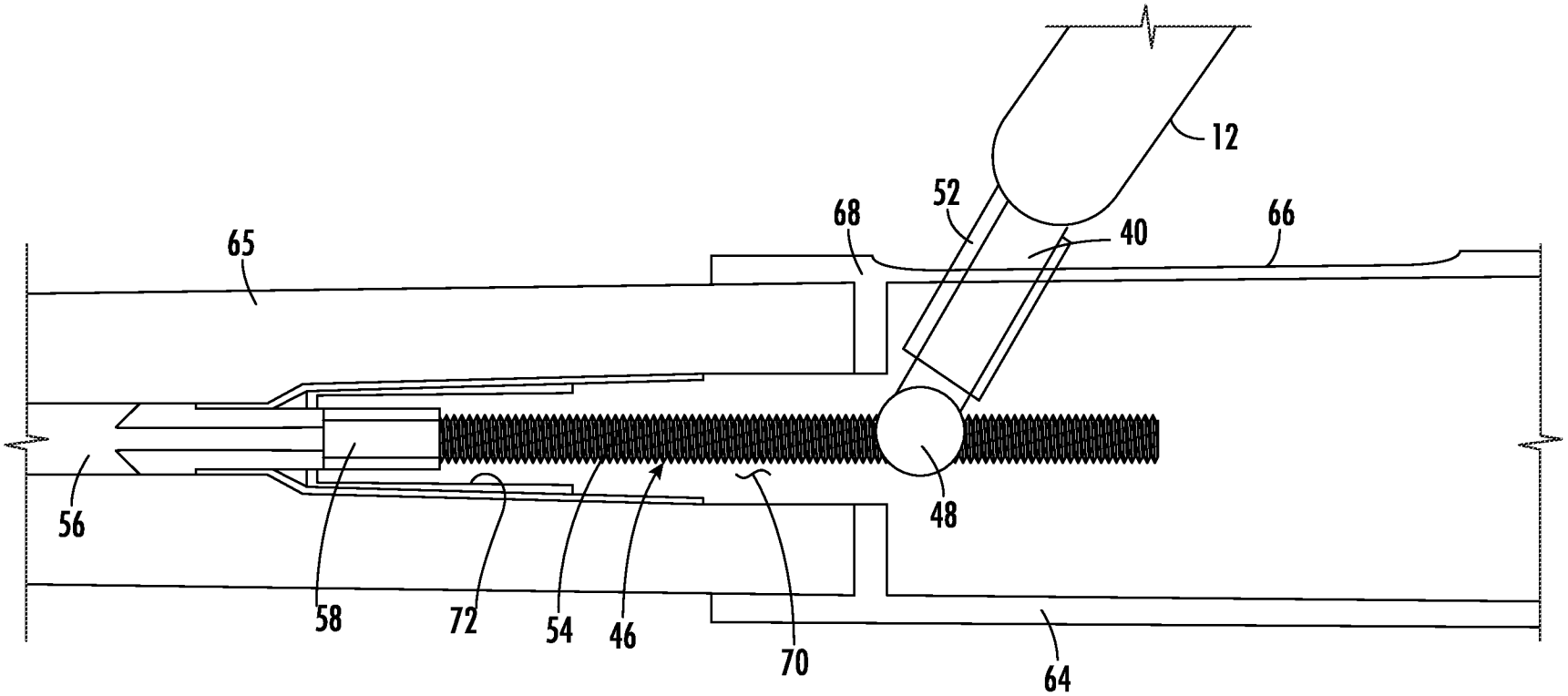
FIG. 9 is a schematic top view of the step of positioning the extractor assembly according to the present invention.
Figure 10:
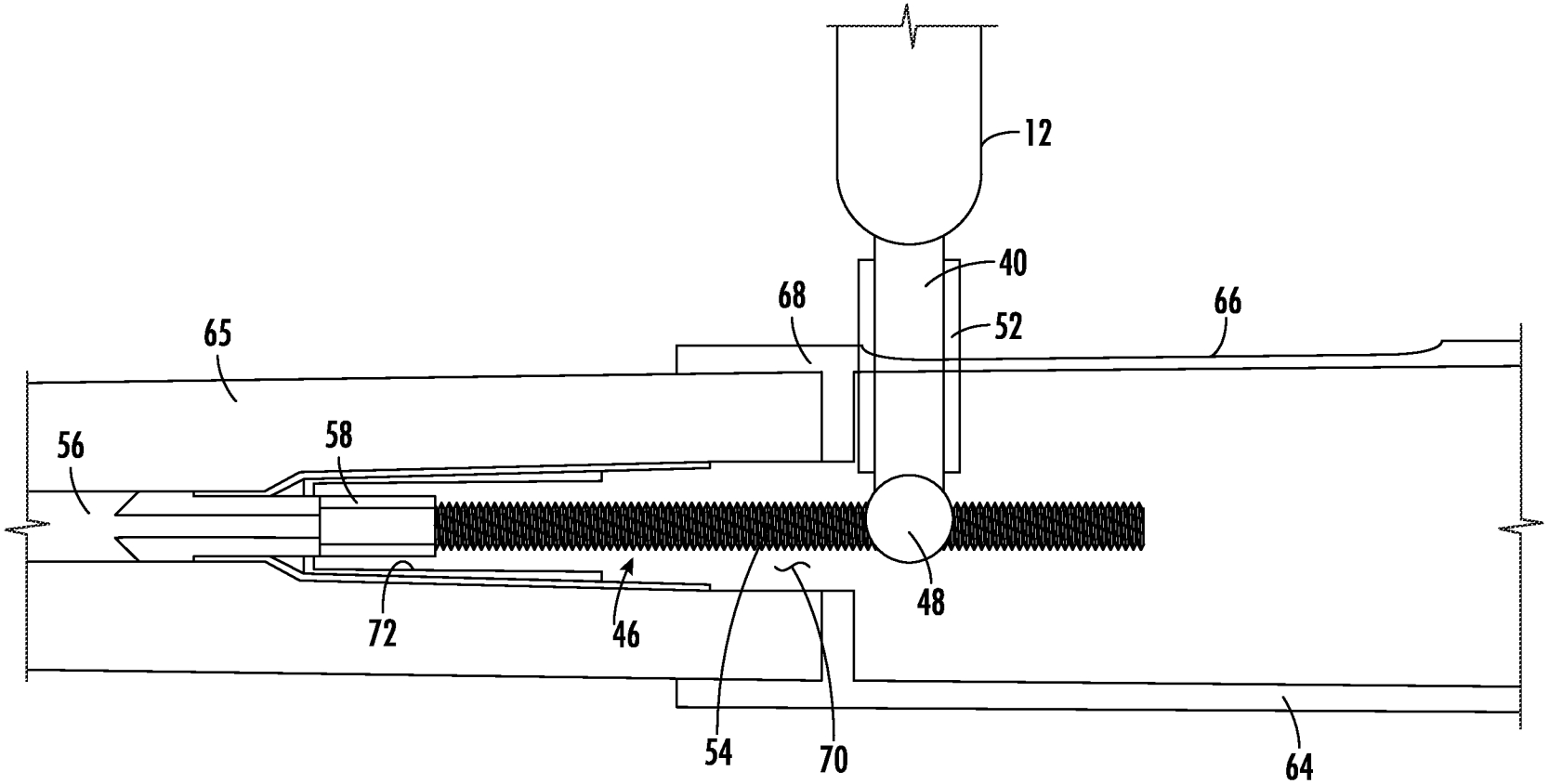
FIG. 10 is a schematic top view of the step of using the extractor assembly to remove a jammed casing according to the present invention.

Turning now to FIGS. 9 and 10, illustrated are schematic diagrams showing the extraction of a casing with a separated head. A portion of a firearm having a receiver 64 with attached barrel 65 is shown from above. Receiver 64 has an ejection port 66 with a forward shoulder 68. A firing chamber 70 is formed between the barrel 65 and receiver 64. To remove a casing 72 with a separated head from firing chamber 70, extractor assembly 14 is moved from the stored position to the deployed position. Referring specifically to FIG. 9, extractor tip 46 is inserted through ejection port 66 and through the rear of casing 72 until extractor element 56 extends down barrel 65 past the end of casing 72. This is only possible when the jam is caused by the separation of the head from the casing. When extractor element 56 clears the end of casing 72, is expands in a known manner, engaging the end of casing 72. Handle 12 is moved forwardly in the direction of arrow B pivoting at hinge ferrule 48 until it engages shoulder 68.

Referring now to FIG. 10, handle 12 is pulled forward, toward the muzzle of the firearm in the direction of arrow B. During this movement, shoulder 68 forms a fulcrum for extension arm 40. Levering handle 12 forward, pulls extractor element 56 rearwardly removing casing 72 from firing chamber 70 with mechanical advantage. Unjamming casing 72 from firing chamber 70 requires only minimal movement of extension arm 40. Guard sleeve 52 is captured between extension arm 40 and shoulder 68, protecting shoulder 68 from any potential damage. Guard sleeve 52 can be any material that will prevent damage to the metal of the receiver, such as aluminum, but will be strong enough to wear and not itself be damaged. Materials can include leather, plastic, rubber and the like. This process can be accomplished in seconds in the field to remove a casing with separated head.

Figure 11:
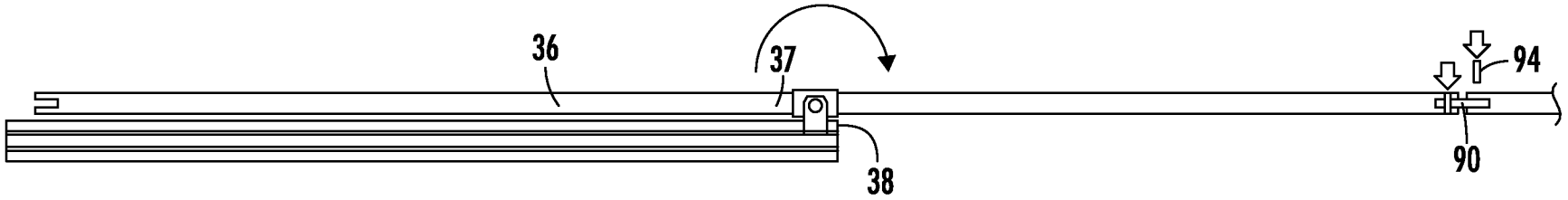
FIG. 11 is a simplified top view of the unjamming multitool with a portion of the collapsible range rod in the deployed position.
Figure 12:
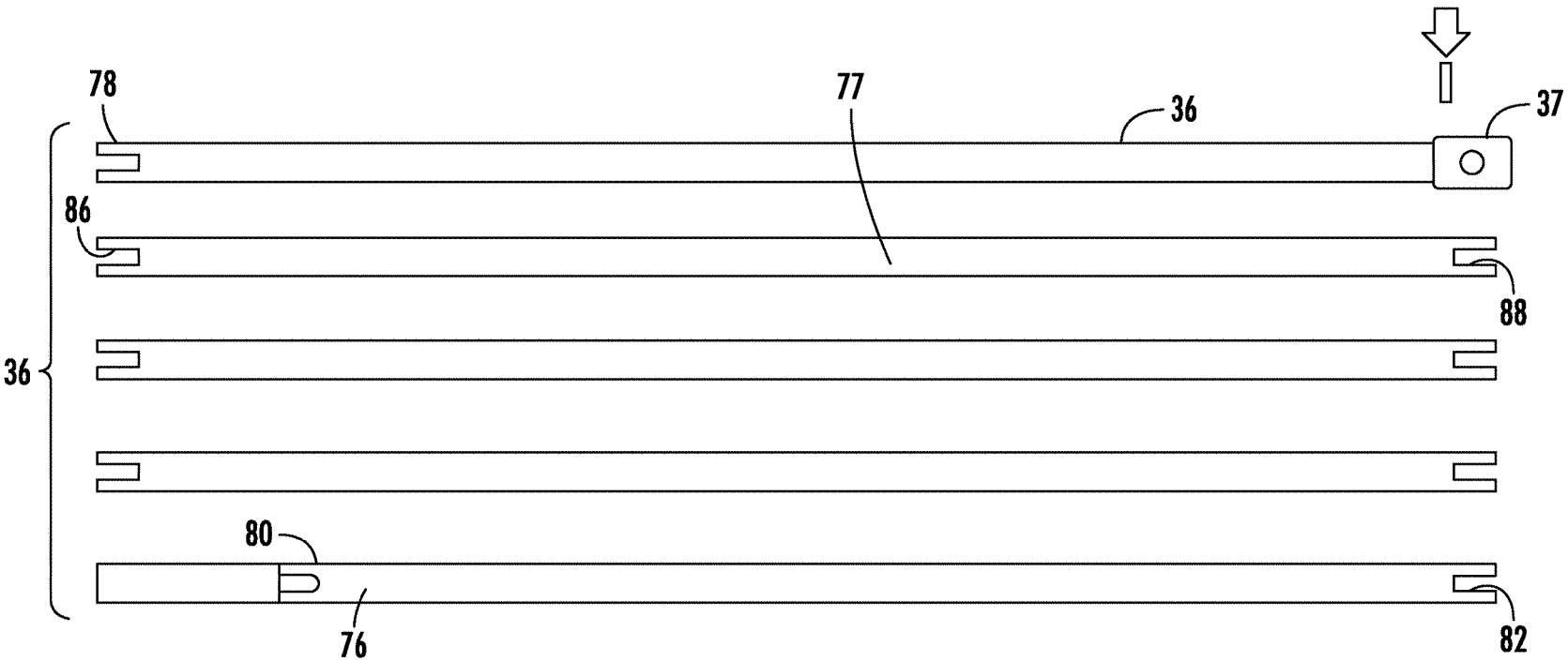
FIG. 12 is an exploded view of the collapsible range rod.

Referring to FIG. 5, with additional reference to FIGS. 11 and 12, end 37 of base segment 36 of collapsible range rod 18 is pivotally coupled to bracket 38 by a pivot pin 75 journaled through end 37 and bracket 38, allowing base segment 36 to move between a stored position against side plate 22 and a deployed position moved in the direction of arrowed line C 180 degrees. Collapsible range rod 18 includes a plurality of segments beginning with base segment 36, at least one intermediate segment 85 and ending at terminal segment 76. Base segment 36 includes end 37 and an opposing slotted end 78. Terminal segment 76 includes a terminal end 80 and an opposing slotted end 82. Terminal end 80 is threaded to receive accessory tips such as cleaning tips, brushes and the like. Intermediate segments 85 each include opposing slotted ends 86 and 88.

Figure 14:
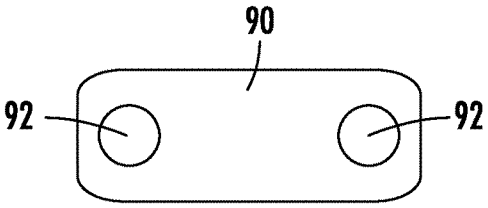
FIG. 14 is an enlarged top view of a link in the coupling for the collapsible range rod.
Figure 13:
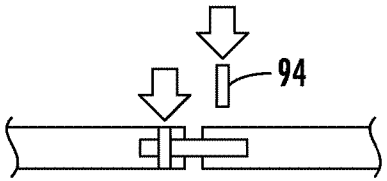
FIG. 13 is a n enlarged view of the coupling between segments of the collapsible range rod.

Referring additionally to FIGS. 13 and 14, each segment is joined to an adjacent segment by a linkage 90 having apertures 92 formed through opposing ends thereof. Slotted ends of the segments are coupled by linkage 90 inserted into the slotted ends and pinned into place by a pair of pins 94 one of each journaled through the slotted ends and apertures 92. Thus, slotted end 78 of base segment 36 and one of slotted ends 86 and 88 of one of intermediate segments 85 are coupled by a linkage 90 inserted into the slotted ends and pinned into place by pins 90 press fit through both slotted ends and linkage as described. Slotted end 82 of terminal segment 76 and one of slotted ends 86 and 88 of one of intermediate segments 85 are coupled in a like manner. While three intermediate segments 85 are illustrated, more or less segments can be utilized as desired, depending upon the length of the barrel of the firearm in which it will be used. In other words, the length of collapsible range rod 18 can be customized to the barrel length of a firearm. In operation, the segments are all pivoted from a stored configuration in which they are parallel, into a deployed position in which the segments are aligned linearly and fed down the barrel of the firearm to be serviced. Once in the barrel, the segments become rigid as they are held in the linear configuration by the barrel. Collapsible range rod 18 can be used in the deployed position to eject a spent casing jammed in the firing chamber due to a damaged rim or the like as discussed previously.

Referring back to FIG. 4, bolt over-ride claw 16 is shown. Bolt over-ride claw 16 is pivotally coupled to end 28 of housing 12 by pivot post 34 and movable between a stored position generally within cavity 30 of housing 12 and a deployed position pivoted outwardly from cavity 30 about pivot post 34. The deployed position is with bolt over-ride claw 16 extending from handle 12 at a 90 degree angle. Claw 16 is generally blade shaped with a blunt tip and a rounded blade. It is used to pry at jammed cases and also can be used to force movement from the bolt. The rounded edges prevent damage to the firearm while allowing insertion into the action of the firearm at multiple angles.

Thus described are multiple unjamming tools carried by a single handle and movable between storage positions and deployed positions. In the storage position, unjamming multitool 10 is compact and easily carried, while each tool can be moved to the deployed position for use when necessary and readily available.

The present invention is described above with reference to illustrative embodiments. Those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

The invention claimed is:

1. An unjamming multitool for use with a firearm, comprising:

a housing having a first end and an opposing second end;

an extension arm having a distal end, and a pivot end pivotally coupled to the first end of the housing by a pivot post and movable between a stored position adjacent the housing and a deployed position wherein the extension arm is pivoted outwardly from the housing about the pivot post to a stop;

a threaded shaft coupled to the distal end of the extension arm by a rotating ferrule for movement between a stored position parallel to the extension arm and a deployed position perpendicular to the extension arm;

an extractor element coupled to an end of the shaft by a spacer; and the threaded shaft having a second end threaded through the rotating ferrule, a distance between the extractor element and the rotating ferrule being adjusted by threading the second end of the threaded shaft through the rotating ferrule a greater distance or a lesser distance.

2. The unjamming multitool for use with a firearm as claimed in claim 1 wherein the housing further comprises:

opposing parallel side plates joined at an edge;

the side plates defining a cavity therebetween; and the pivot post carried at the first end extends between the side plates through the cavity.

3. The unjamming multitool for use with a firearm as claimed in claim 1 wherein the rotating ferrule is coupled to the distal end of the extension arm by a pivot pin for pivotal movement of the rotating ferrule.

4. The unjamming multitool for use with a firearm as claimed in claim 1 wherein the extension arm is covered by a guard sleeve for capture between the extension arm and a shoulder of an ejection port of a firearm when in use.

5. The unjamming multitool for use with a firearm as claimed in claim 2 further comprising:

a base segment having an end pivotally coupled to one of the opposing parallel side plates opposite the cavity movable between a stored position against the one of the opposing parallel side plates and a deployed position, moving 180 degrees and extending from the one of the opposing parallel side plates, and a slotted end an intermediate segment having opposed slotted ends;

a terminal segment having a terminal end and an opposing slotted end; and a first linkage coupling the slotted end of the base segment to one of the slotted ends of the intermediate segment; and a second linkage coupling the other of the slotted ends of the intermediate segment to the slotted end of the terminal segment.

6. The unjamming multitool for use with a firearm as claimed in claim 5 wherein the base segment, the intermediate segment and the terminal segment are movable between a stored position wherein each is position parallel to each other and resting against the one of the opposing side plates, and a deployed configuration wherein the base segment, the intermediate segment and the terminal segment extend linearly and are swiveled away from the one of the opposing side plates by up to 180 degrees.

7. The unjamming multitool for use with a firearm as claimed in claim 2 further comprising a bolt over-ride claw pivotally coupled to the opposing second end of the housing by a pivot post carried by the opposing second end, and movable between a stored position generally within the cavity of housing and a deployed position pivoted outwardly from the cavity to a 90 degree stop.

8. An unjamming multitool for use with a firearm, comprising:

a housing having opposing parallel side plates joined at an edge and having a first end and an opposing second end, the opposing parallel side plates defining a cavity therebetween, a first pivot post carried at the first end and extending between the opposing parallel side plates through the cavity and a second pivot post carried at the second end of the housing and extending between the opposing parallel side plates through the cavity;

an extractor assembly pivotally coupled to the first end of the housing by the first pivot post and movable between a stored position adjacent the housing and a deployed position wherein the extractor assembly is pivoted outwardly from the housing about the first pivot post to a stop;

a bolt over-ride claw coupled to the opposing second end of the housing by the second pivot post, and movable between a stored position generally within the cavity of the housing and a deployed position pivoted outwardly from the cavity to a 90 degree stop; and a collapsible range rod movable between a stored position against one of the opposing parallel side plates and a deployed position extending from the one of the opposing parallel side plates, the collapsible range rod comprising a base segment having an end pivotally coupled to one of the opposing parallel side plates opposite the cavity and movable between a stored position against the one of the opposing parallel side plates and a deployed position, moving 180 degrees and extending from the one of the opposing parallel side plates, and a slotted end;

an intermediate segment having opposed slotted ends;

a terminal segment having a terminal end and an opposing slotted end;

a first linkage coupling the slotted end of the base segment to one of the slotted ends of the intermediate segment; and a second linkage coupling the other of the slotted ends of the intermediate segment to the slotted end of the terminal segment.

9. The unjamming multitool for use with a firearm as claimed in claim 8, wherein the extractor assembly further comprises:

an extension arm having a distal end, and a pivot end pivotally coupled to the first end of the housing by the first pivot post and movable between a stored position adjacent the housing and a deployed position wherein the extension arm is pivoted outwardly from the housing about the first pivot post;

a shaft coupled to the distal end of the extension arm by a rotating ferrule for movement between a stored position parallel to the extension arm and a deployed position perpendicular to the extension arm; and an extractor element coupled to an end of the shaft by a spacer.

10. The unjamming multitool for use with a firearm as claimed in claim 9 wherein the extension arm is covered by a guard sleeve for capture between the extension arm and a shoulder of an ejection port of a firearm when in use.

11. The unjamming multitool for use with a firearm as claimed in claim 9 wherein the shaft is threadably and adjustably received by the rotating ferrule.

12. The unjamming multitool for use with a firearm as claimed in claim 8 wherein the base segment, the intermediate segment and the terminal segment are movable between stored position wherein each is position parallel to each other and resting against the one of the opposing side plates, and a deployed configuration wherein the base segment, the intermediate segment and the terminal segment extend linearly and are swiveled away from the one of the opposing side plates by up to 180 degrees.

13. An unjamming multitool for use with a firearm, comprising:

a housing having opposing parallel side plates joined at an edge and having a first end and an opposing second end, the opposing parallel side plates defining a cavity therebetween, a first pivot post carried at the first end and extending between the opposing parallel side plates through the cavity and a second pivot post carried at the second end of the housing and extending between the opposing parallel side plates through the cavity;

an extractor assembly including an extension arm having a distal end, and a pivot end pivotally coupled to the first end of the housing by the first pivot post and movable between a stored position adjacent the housing and a deployed position wherein the extension arm is pivoted outwardly from the housing about the first pivot post, a shaft coupled to the distal end of the extension arm by a rotating ferrule for movement between a stored position parallel to the extension arm and a deployed position perpendicular to the extension arm, and an extractor element coupled to a first end of the shaft by a spacer, the threaded shaft having a second end threaded through the rotating ferrule, a distance between the extractor element and the rotating ferrule being adjusted by threading the second end of the threaded shaft through the rotating ferrule a greater distance or a lesser distance;

a bolt over-ride claw coupled to the opposing second end of the housing by the second pivot post, and movable between a stored position generally within the cavity of the housing and a deployed position pivoted outwardly from the cavity to a 90 degree stop; and a collapsible range rod movable between a stored position against one of the opposing parallel side plates and a deployed position extending from the one of the opposing parallel side plates.

14. The unjamming multitool for use with a firearm as claimed in claim 13 wherein the extension arm is covered by a guard sleeve for capture between the extension arm and a shoulder of an ejection port of a firearm when in use.

15. The unjamming multitool for use with a firearm as claimed in claim 13, wherein the collapsible range rod further comprises:

a base segment having an end pivotally coupled to one of the opposing parallel side plates opposite the cavity and movable between a stored position against the one of the opposing parallel side plates and a deployed position, moving 180 degrees and extending from the one of the opposing parallel side plates, and a slotted end;

an intermediate segment having opposed slotted ends;

a terminal segment having a terminal end and an opposing slotted end;

a first linkage coupling the slotted end of the base segment to one of the slotted ends of the intermediate segment; and a second linkage coupling the other of one of the slotted ends of the intermediate segment to the slotted end of the terminal segment.

16. The unjamming multitool for use with a firearm as claimed in claim 15 wherein the base segment, the intermediate segment and the terminal segment are movable between a stored position wherein each is position parallel to each other and resting against the one of the opposing side plates, and a deployed configuration wherein the base segment, the intermediate segment and the terminal segment extend linearly and are swiveled away from the one of the opposing side plates by up to 180 degrees.

* * * * *